US007063432B2

(12) United States Patent
VanderSchuit

(10) Patent No.: US 7,063,432 B2
(45) **Date of Patent: *Jun. 20, 2006**

(54) BEVERAGE ACCESSORY DEVICE

(76) Inventor: Carl R VanderSchuit, 751 Turquoise St., San Diego, CA (US) 92109

( * ) Notice: Subject to any disclaimer, the term of this patent is extended or adjusted under 35 U.S.C. 154(b) by 31 days.

This patent is subject to a terminal disclaimer.

(21) Appl. No.: 10/998,347

(22) Filed: Nov. 24, 2004

(65) Prior Publication Data

US 2005/0073833 A1 Apr. 7, 2005

Related U.S. Application Data

(63) Continuation-in-part of application No. 10/189,822, filed on Jul. 3, 2002, now Pat. No. 6,824,289, which is a continuation of application No. 09/627,961, filed on Jul. 28, 2000, now Pat. No. 6,416,198.

(60) Provisional application No. 60/154,424, filed on Sep. 17, 1999.

(51) Int. Cl.
*F21V 33/00* (2006.01)

(52) U.S. Cl. ..... 362/101; 362/158; 362/205; 362/318; 362/394

(58) Field of Classification Search ..... 362/101, 362/154, 318, 253, 394, 205, 184, 158; 441/16; 43/17.5, 17; 340/604, 309.4
See application file for complete search history.

(56) References Cited

U.S. PATENT DOCUMENTS

| | | | |
|---|---|---|---|
| 1,107,645 | A | 8/1914 | Benedict |
| 1,923,522 | A | 8/1933 | Whitehouse |
| 2,152,467 | A | 3/1939 | Crosby |
| 3,099,565 | A | 7/1963 | Neuhauser |
| 3,559,224 | A | 2/1971 | Shimizu |
| 3,580,575 | A | 5/1971 | Speeth |
| 3,735,113 | A | 5/1973 | Stolt |
| 3,818,208 | A | 6/1974 | Kahl |
| 4,034,231 | A | 7/1977 | Conn et al. |
| 4,109,405 | A | 8/1978 | Ito |
| 4,124,881 | A | 11/1978 | Haber |
| 4,181,304 | A | 1/1980 | Haber |
| 4,183,316 | A | 1/1980 | Bennett |
| 4,237,525 | A | 12/1980 | Deter |

(Continued)

FOREIGN PATENT DOCUMENTS

| | | |
|---|---|---|
| CH | 662 931 | 11/1987 |

(Continued)

OTHER PUBLICATIONS

Special Verdict Form with jury decision rendered on Oct. 7, 2005 from litigation in the U.S. District Court for the Eastern District of Missouri captioned *Litecubes, LLC and Carl R. VanderSchuit v. Northern Ligth Products, Inc.*, Case No.4:04CV00485 ERW, 5 pages.

(Continued)

*Primary Examiner*—Sandra O'Shea
*Assistant Examiner*—Jacob Y. Choi
(74) *Attorney, Agent, or Firm*—Harness, Dickey & Pierce, P.L.C.

(57) ABSTRACT

A beverage accessory device includes a housing defining a cavity therein, and a substantially fluid-tight container within the housing. At least light source and at least one power source are both positioned within the container. When connected to the power source, the light source illuminates at least a portion of a liquid when the beverage accessory device is placed in the liquid.

39 Claims, 7 Drawing Sheets

U.S. PATENT DOCUMENTS

| | | | | |
|---|---|---|---|---|
| 4,309,743 | A | | 1/1982 | Martin |
| 4,325,230 | A | | 4/1982 | Driscoll |
| 4,331,848 | A | | 5/1982 | Schneider, Jr. |
| 4,341,087 | A | | 7/1982 | Steenburgh |
| 4,390,928 | A | | 6/1983 | Runge |
| 4,409,644 | A | | 10/1983 | Axton et al. |
| D272,128 | S | | 1/1984 | Parmentier |
| D272,232 | S | | 1/1984 | Parmentier |
| 4,464,131 | A | | 8/1984 | Plante et al. |
| 4,545,479 | A | | 10/1985 | Figari |
| 4,553,194 | A | | 11/1985 | Bailey |
| 4,554,189 | A | | 11/1985 | Marshall |
| 4,556,932 | A | | 12/1985 | Lehrer |
| 4,605,882 | A | | 8/1986 | DeLuca |
| 4,638,409 | A | | 1/1987 | Berman |
| 4,641,840 | A | | 2/1987 | Larson |
| 4,719,544 | A | | 1/1988 | Smith |
| 4,733,785 | A | | 3/1988 | Turner, Jr. et al. |
| 4,761,314 | A | | 8/1988 | Marshall |
| 4,796,167 | A | | 1/1989 | Brown et al. |
| 4,827,655 | A | | 5/1989 | Reed |
| 5,018,053 | A | | 5/1991 | Belknap |
| 5,027,258 | A | | 6/1991 | Schoniger et al. |
| 5,054,778 | A | * | 10/1991 | Maleyko ..... 473/570 |
| 5,070,435 | A | | 12/1991 | Weller |
| 5,070,437 | A | | 12/1991 | Roberts, Sr. |
| 5,119,279 | A | | 6/1992 | Makowsky |
| 5,143,439 | A | | 9/1992 | Lewis |
| 5,201,578 | A | | 4/1993 | Westmoland |
| 5,211,699 | A | | 5/1993 | Tipton |
| 5,231,781 | A | | 8/1993 | Dunbar |
| 5,253,149 | A | | 10/1993 | Ostema |
| 5,276,599 | A | | 1/1994 | Neeley |
| 5,295,882 | A | | 3/1994 | McDermott |
| 5,323,300 | A | | 6/1994 | McCrary |
| 5,438,488 | A | | 8/1995 | Dion |
| 5,463,537 | A | | 10/1995 | Trattner et al. |
| D365,911 | S | | 1/1996 | Cassetti et al. |
| 5,497,307 | A | | 3/1996 | Bae |
| 5,516,317 | A | | 5/1996 | Moody |
| 5,575,553 | A | | 11/1996 | Tipton |
| 5,603,219 | A | | 2/1997 | Kolb |
| 5,609,411 | A | | 3/1997 | Wang |
| 5,622,422 | A | | 4/1997 | Rodgers |
| 5,624,177 | A | | 4/1997 | Rosaia |
| 5,632,548 | A | | 5/1997 | Mayfarth |
| 5,636,770 | A | | 6/1997 | Hachinohe et al. |
| 5,649,758 | A | | 7/1997 | Dion |
| 5,653,524 | A | | 8/1997 | Gray |
| 5,697,182 | A | | 12/1997 | Rodgers |
| 5,743,620 | A | | 4/1998 | Rojas |
| 5,763,845 | A | | 6/1998 | Hsieh |
| 5,775,800 | A | | 7/1998 | Hsieh |
| 5,784,265 | A | | 7/1998 | Chen |
| 5,785,407 | A | | 7/1998 | Ratcliffe |
| 5,860,724 | A | | 1/1999 | Cheng |
| 5,876,109 | A | | 3/1999 | Scalco |
| 5,879,068 | A | | 3/1999 | Menashrov |
| 5,903,212 | A | | 5/1999 | Rodgers |
| 5,934,519 | A | | 8/1999 | Kim et al. |
| 5,934,784 | A | | 8/1999 | Dion |
| 5,971,827 | A | | 10/1999 | Lee et al. |
| 6,106,130 | A | | 8/2000 | Harding |
| 6,106,132 | A | | 8/2000 | Chen |
| 6,116,753 | A | | 9/2000 | Tsang |
| 6,135,604 | A | | 10/2000 | Lin |
| 6,155,700 | A | | 12/2000 | Hsu |
| 6,254,247 | B1 | | 7/2001 | Carson |
| 6,277,079 | B1 | | 8/2001 | Avicola |
| 6,352,352 | B1 | | 3/2002 | Schletterer et al. |
| 6,354,460 | B1 | | 3/2002 | Cornell et al. |
| 6,354,711 | B1 | | 3/2002 | McCoy |
| 6,375,092 | B1 | | 4/2002 | Banach |
| 6,416,198 | B1 | | 7/2002 | VanderSchuit |
| 6,481,148 | B1 | | 11/2002 | Lindgren |
| 2004/0136189 | A1 | | 7/2004 | VanderSchuit |
| 2004/0208001 | A1 | | 10/2004 | Liu |
| 2004/0233674 | A1 | | 11/2004 | VanderSchuit |

FOREIGN PATENT DOCUMENTS

| | | | |
|---|---|---|---|
| CN | ZL 033562709 | | 8/2003 |
| CN | ZL 033562717 | | 8/2003 |
| DE | 299 18 185 | | 2/2000 |
| EP | 0 231 471 | | 2/1986 |
| EP | 1313986 | | 5/2003 |
| GB | 2381575 | | 5/2003 |
| GB | 2 392 973 | A | 3/2004 |
| JP | 06-267327 | | 9/1994 |
| JP | 07-289405 | | 11/1995 |
| JP | 2002-245802 | | 8/2002 |
| JP | 2003-137014 | | 5/2003 |
| JP | 2003-259951 | | 9/2003 |
| JP | 2004-105231 | | 4/2004 |
| WO | WO 93/18358 | | 2/1993 |
| WO | WO/02/10642 | | 2/2002 |
| WO | WO 04/005796 | | 11/2003 |

OTHER PUBLICATIONS

Memorandum and Order dated Sep. 2, 2005 from litigation in the U.S. District Court for the Eastern District of Missouri captioned *Litecubes, LLC and Carl R. VanderSchuit v. Northern Ligth Products, Inc.*, Case No.4:04CV00485 ERW, 8 pages.

Memorandum and Order dated Aug. 2, 2005 from litigation in the U.S. District Court for the Eastern District of Missouri captioned *Litecubes, LLC and Carl R. VanderSchuit v. Northern Ligth Products, Inc.*, Case No.4:04CV00485 ERW, 12 pages.

Defendant's Motion for Summary Judgment for Patent Invalidity (and exhibits), filed on Apr. 12, 2005 in pending litigation in the U.S. District Court for the Eastern District of Missouri captioned *Litecubes, LLC And Carl R. VanderSchuit v. Northern Light Products, Inc.*, Case No.4:04-V-00485-ERW.

Litecube's Memorandum in Opposition to Glowproducts' Motion for Summary Judgment for Patent Invalidity (and exhibits), filed on May 12, 2005 in pending litigation in the U.S. District Court for the Eastern District of Missouri captioned *Litecubes, LLC and Carl R. VanderSchuit v. Northern Light Products, Inc.*, Case No.4:04-V-00485-ERW.

Litecube's Amended Memorandum in Opposition to Glowproducts' Motion for Summary Judgment for Patent Invalidity (and exhibits), filed on May 12, 2005 in pending litigation in the U.S. District Court for the Eastern District of Missouri captioned *Litecubes, LLC and Carl R. VanderSchuit v. Northern Light Products, Inc.*, Case No.4:04-V-00485-ERW.

U.S. Appl. No. 10/606,314, entitled Lighted Hat, filed Jun. 25,2003, VanderSchuit.

U.S. Appl. No. 10/606,324, entitled Lighting Device, filed Jun. 25, 2003, VanderSchuit.

U.S. Appl. No. 10/606,325, entitled Lighted Hat, filed Jun. 25, 2003, VanderSchuit.

U.S. Appl. No. 10/786,995, entitled Therapeutic Device and Methods for Applying Therapy, filed Feb. 25, 2004, VanderSchuit.

The Written Opinion for International Application PCT/US01/16640, dated Apr. 25, 2002, 7 pages.
International Preliminary Examination Report for International Application PCT/US01/16640, dated Jan. 27, 2003, 7 pages.
International Search Report dated Nov. 3, 2003 from PCT Application Serial No. PCT/US03/20521 filed Jun. 27, 2003, claiming priority to U.S. Appl. No. 10/189,822, 4 pages.
European Examination Report, Application No. 01 939 305.7-2313, dated May 13, 2004, 3 pages.
United Kingdom Combined Search and Examination Report dated Jan. 6, 2004; Application No. GB 0326549.3; 4 pages.
Supplementary European Search Report dated Mar. 1, 2004; App. No. EP 01 93 9305; 3 pages.
Second European Examination Report, Application No. 01 939 305.7, dated Oct. 1, 2004, 3 pages.

* cited by examiner

BEVERAGE ACCESSORY DEVICE

CROSS-REFERENCE TO RELATED APPLICATIONS

This application is a continuation-in-part of application Ser. No. 10/189,822, filed Jul. 3, 2002, now U.S. Pat. No. 6,824,289, issued Nov. 30, 2004, which is a continuation-in-part of application Ser. No. 09/627,961, filed Jul. 28, 2000, now U.S. Pat. No. 6,416,198, issued Jul. 9, 2002, which claimed priority to U.S. Provisional Application 60/154,424, filed Sep. 17, 1999. The entire disclosures of the above applications are incorporated herein by reference.

FIELD OF THE INVENTION

The present invention relates generally to novelty-related accessory items, and more particularly (but not exclusively) to illuminating beverage accessory devices for use in containers filled with liquids.

BACKGROUND OF THE INVENTION

Currently, there are several novelty-related devices resembling ice cubes. But they are either complex in structure or in use or both. For example, U.S. Pat. No. 5,860,724 issued to Cheng describes a luminescent light emitter shaped like an ice cube having several chambers each filled with chemicals that when mixed together emit light. But the Cheng device has a complex construction, requiring chemicals, and is relatively burdensome to use.

U.S. Pat. No. 5,903,212 issued to Rodgers is even more complex. The Rodgers device is motion-sensitive such that the device is powered by any motion through a motion-responsive ball-switch within. Although relatively easy to use, the Rodgers device has an extremely complex structure.

SUMMARY OF THE INVENTION

In one exemplary embodiment, a beverage accessory device includes a housing defining a cavity therein, and a substantially fluid-tight container within the housing. At least one light source and at least one power source are both positioned within the container. When connected to the power source, the light source illuminates at least a portion of a liquid when the beverage accessory device is placed in the liquid.

In another exemplary embodiment, a beverage accessory device includes a housing defining a cavity therein, and a cartridge within the housing. The cartridge defines thereunder a light source chamber and a power source chamber such that the light source chamber and power source chamber are substantially sealed from the cavity. The power source chamber is configured to receive at least one power source therein. At least one light source is within the light source chamber. When connected to the power source, the light source illuminates at least a portion of a liquid when the beverage accessory device is placed in the liquid.

Further areas of applicability of the present invention will become apparent from the detailed description provided hereinafter. It should be understood that the detailed description and specific examples below, while indicating exemplary embodiments of the invention, are intended for purposes of illustration only and are not intended to limit the scope of the invention.

BRIEF DESCRIPTION OF THE DRAWINGS

The present invention will be more fully understood from the detailed description and the accompanying drawings, wherein.

DETAILED DESCRIPTION OF EXEMPLARY EMBODIMENTS

Figure 1:
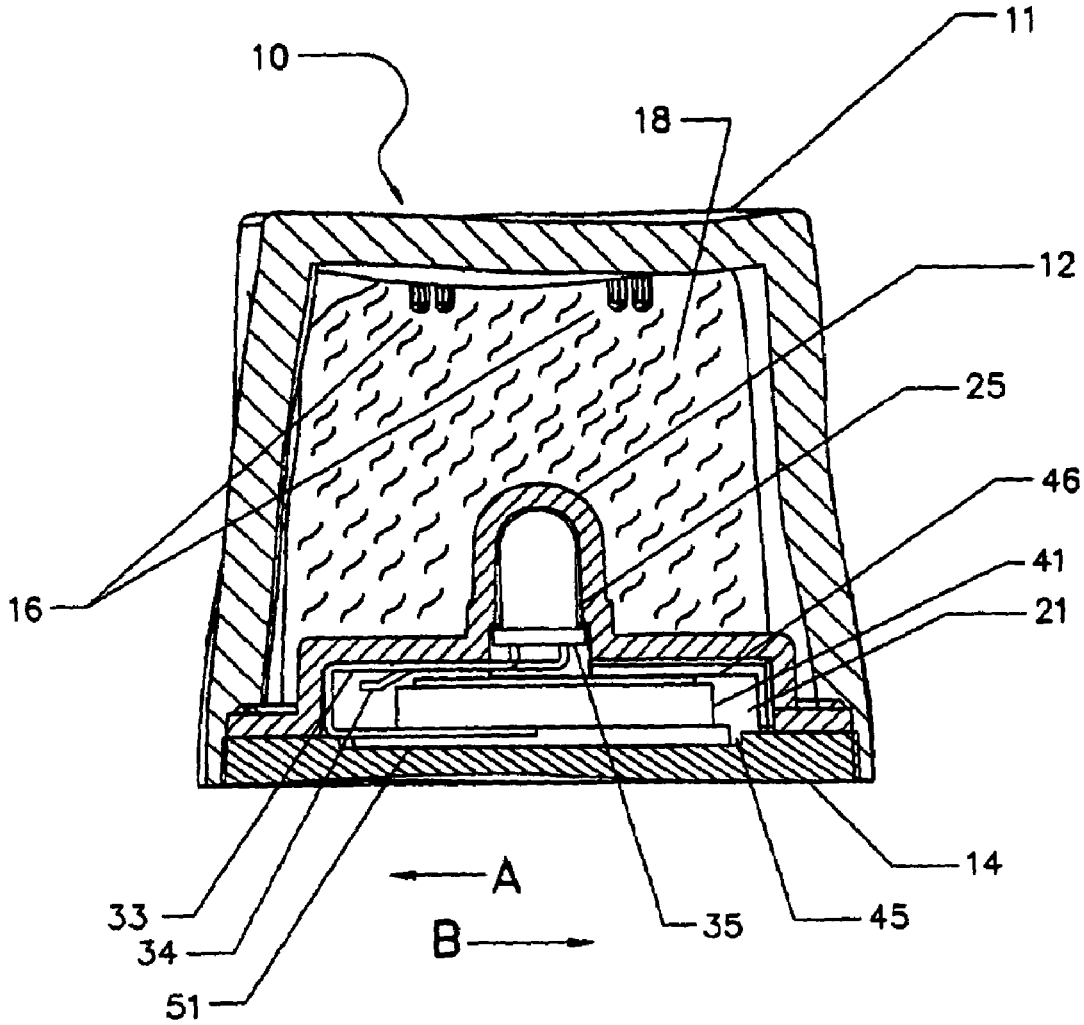
FIG. 1 is a cross-sectional elevation view of the beverage accessory according to one embodiment of the invention.

Referring now to the drawings in detail and in particular to FIG. 1, reference character 10 generally designates a beverage accessory device constructed in accordance with one embodiment of the present invention.

As shown, the beverage accessory device 10 includes a housing 11 which rests on a lid 14. Within the housing 11 seated on the lid 14 is a cartridge 12. A cavity is, though need not be, formed above the cartridge 12. A cavity is preferred but the space above the cartridge 12 also may be part of the inner housing itself, a single-piece or of a solid construction fitted onto or be a part of the cartridge 12. This solid inner housing may be transparent or translucent and/or comprise any one or more colors or tints or shades.

The cartridge 12 can be fixedly sealed to the lid 14 and each, the cartridge 12 and the lid 14, can be fixedly sealed to the housing 11 thereby creating a water-tight integrity for the beverage accessory device 10. It must be understood, however, that any one or more of these parts (that is, the housing 11, the cartridge 12, and the lid 14) may be removably attached to any one or all of the other parts, or fixedly attached to any one or all of the others, or in any combination thereof. For maintaining water-tight integrity, a fixed seal is preferred.

Figure 2:
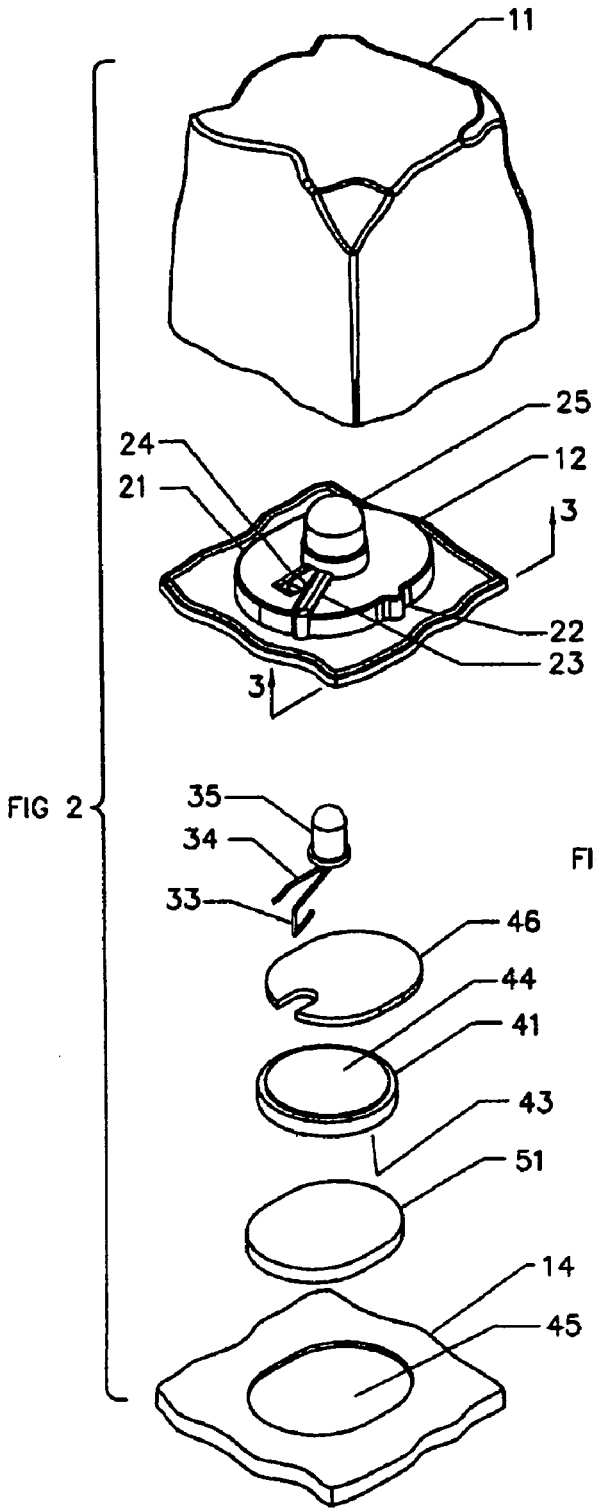
FIG. 2 is an exploded view of the beverage accessory of FIG. 1.
Figure 3:
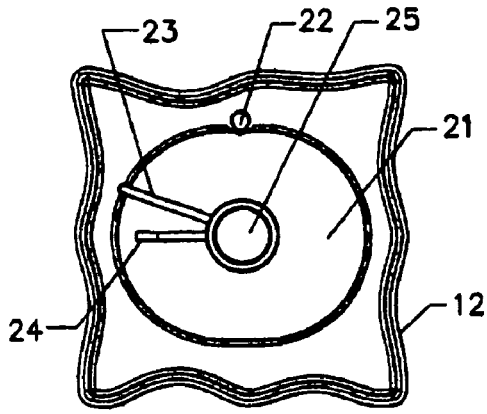
FIG. 3 is a planar view of a portion of the beverage accessory as taken along line 3—3 of FIG. 2.

Reference is now made to FIGS. 1 through 3. Within the cartridge 11 is a light source chamber 25, a power source chamber 21, a detent 22 or similar structure suited for the intended purpose of restricting the (unwanted) movement of the power source 41 (having a negative terminal or cathode 44 and a positive terminal or anode 43) within the power source chamber 21, and wire lead channels 23, 24 adapted to receive the respective wire leads 33, 34 from the light source 35. The light source 35 seats into the light source chamber 25. Its wire leads 33, 34 seat into the respective wire lead channels 23, 24 of the underside of the cartridge 12. The power source 41 is seated into the power source chamber 21 directly below the light source 35. The power source chamber 21 is sized such that the power source 41 may slide from one side to another side as depicted by direction arrows A and B in FIG. 1 (for reference purposes only, and not by way of limitation, FIG. 1 depicts a right to left translation of the power source 41 and in this vein, the power source chamber 21 is slightly longer than the length of the power source 41). Side to side length of the power source chamber 21 is slightly less than the length of the power source 41 to provide the clearance necessary to permit movement in directions A and B when desired. Undesired movement within the power source chamber 21 of the power source 41 is restricted by placement of a detent 22 within the power source chamber 21, or similar structure suited for the intended purpose such as, but not limited to a nub, a bias member, a pin, and the like. Those skilled in the art, however, will recognize that any restricting-type mechanism suited for the intended purposes may be employed and are not limited to these forms of restricting-type mechanisms described above.

One wire lead (for example purposes only, and not by way of limitation, it is wire lead 33) extends from the light source 35 around the inner perimeter of the power source chamber 21 to the bottom of the power source 41 as follows: from upper chamber wall to the left side wall then down to the bottom chamber wall and then to the right. This wire lead 33 is in continuous communication with one terminal of the power source (for example purposes only, and not by way of limitation, the wire lead 33 communicates with the positive terminal on the bottom of the power source 41). Below the power source 41 and inside the lid chamber 45 is a bias member 51. The bias member 51 is seated in the lid chamber 45 and is adapted to apply force on and/or support to the power source 41 such that the power source 41 does not and cannot easily move or translate from side to side (directions of arrows A or B) unless external force is applied to overcome the force and support being applied by the bias member 51 to then cause such movement.

Wire lead 34 from light source 35 in this example is the negative lead and seats in lead channel 34 of the underside of the cartridge 21. As illustrated in FIG. 1, this wire lead 34 is positioned well away from contact with the power source 41 when power source 41 is, by way of this example only, in the full right side position (moved fully in the direction of arrow B). This wire lead 34 is slightly downward angled left of center such that, when the power source 41 is slid in the direction of arrow A, the top side (in this example, the negative terminal) of the power source 41 contacts this wire lead 34 thereby completing the circuit causing the light to power 'on'. When the power source is slid sufficiently in the direction of arrow B, contact between the wire lead 34 and the negative terminal of the power source 41 is broken and light emission from the light source 35 will terminate. To prevent undesired contact between wire lead 33 (positive in this example) and the negative terminal of the power source (top in this example) and undesired contact between wire lead 34 (negative lead in this example) and the negative terminal of the power source 41 (top in this example) an insulator has been inserted on the top (as viewed from the perception of FIG. 1) of the power source chamber 21 between the two wire leads 33, 34 and the top of the power source 41. The insulator 46, however, should extend approximately up to wire lead 33 at a point where it is desired that the wire lead 33 come in contact with the top of the power 41 when the power source 41 is caused to move in direction A (in this example, and not by way of limitation, this point is approximately where the downward angling of wire lead 33 begins).

The beverage accessory device is preferably formed from biologically safe material that has properties suitable for placing it in contact with a material that is to be ingested and falls under the Food and Drug Administration food-contact grade properties. Exemplary materials include polymers, plastics, flexible materials, rigid materials, materials capable of being mass produced with relatively low manufacturing costs, among other materials suited for the intended purpose.

The beverage accessory device also could be manufactured from, or filled with, a material capable of maintaining cold or heat if the beverage accessory device is cooled or heated as the case may be. As such, the beverage accessory device could impart such properties to a drink if desired. As stated earlier, the housing 11 may be hollow; that is, have a cavity within and above the cartridge 12. In such cases, the cavity may be filled with a filler 18 such as, but not limited to, water, jell, powder, metals, heat-retaining materials, cold-retaining materials, ultra-violet materials, materials having a fluorescent or glow-in-the-dark quality and the like, all may be either colored or clear or translucent or any combination thereof. Depending on the material used, such filler 18, if frozen or heated, could impart greater cooling or heating properties, respectively, than a solid housing 11. For cooling and heating properties, a wide range of suitable materials can be used including commercially available materials bearing cold-retaining and/or heat-retaining properties such as, but not limited to, materials generally used in re-usable ice-packs, re-usable heating pads, hot/cold gel packs, single-use hand and toe warmers, among other suitable known (and presently unknown) materials. Those skilled in the art, however, will recognize that any filler suited for the intended purposes may be employed and are not limited to these forms of fillers described above. Glow-in-the-dark fillers of varying colors are well-suited for mood enhancing. Positively buoyant fillers are well-suited to establish positive buoyancy such that the device will float within the liquid. Any convention fillers suited for the intended purpose and purposes will suffice.

Having a solid inner housing 11 or a filler 18 within creates a negative buoyancy to the beverage accessory device. Adjusting such combinations of filler 18 and/or solid inner housing 11 or retaining an unused cavity would generally create a positive buoyancy for the beverage accessory device. Since the beverage accessory device could be used as a novelty ice cube, its outer features could simulate the contours and somewhat curved corners of a real ice cube. It could resemble that of a melted or partially melted or melting ice cube complete with a convoluted exterior surface. Shape, for this purpose, would enhance the pleasure of its use. Indicia, external or internal, could be displayed by the beverage accessory device. Such indicia could impart holiday themes, professional themes, promotional themes, sports related themes, and the like. Those skilled in the art, however, will recognize that any theme suited for the intended purposes may be employed and are not limited to these types of themes described above.

In an embodiment where the lid chamber 45 is somewhat or completely transparent, the portion of the bias member 51 which is exposed to the lid chamber 45 (bottom of bias member 51 for example) could contain any indicia which, as a result of the transparency of the lid chamber 45, is exposed to outside viewers. As above, such indicia also could impart holiday themes, professional themes, promotional themes, sports related themes, and the like. This bottom of the bias member 51 could be of a glossy surface, a non-glossy surface, smooth, or textured, or any combination thereof.

In an embodiment where the inner housing 11 is a cavity, a display mechanism 16 may be connected to any one or more side walls or the top of the housing 11. The display mechanism is adapted to receive and hold, but is not limited to, a display placard, plaque, card, any two- or three-dimensional objects, and the like, or any combination thereof which may convey a message, project an image or impression, or to merely bring entertainment to the user of the beverage accessory device; to the user. Any display mechanism suited for the intended purpose will suffice, including, but not limited to, clips, slots, hooks, rollers, tabs, and the like. Those skilled in the art, however, will recognize that any display mechanism suited for the intended purposes may be employed and are not limited to these forms of display mechanisms described above.

The light source 35 can be any source which can illuminate the beverage accessory device and preferably the surrounding environment into which the beverage accessory device is placed; into a drink (floating or not), in a planter, in a fish bowl, on a dinner table, at a picnic, and the like. Any light source 35 suited for the intended purpose will suffice, such as, but not limited to light-emitting diodes (LEDs), fiber optics, halogen, incandescent, laser, fluorescent, phosphorescent, chemiluminescent, electroluminescent, neon light sources, ultraviolet lights, black lights, magnetic, and the like. It is preferred, however, that the light source 35 not impart excessive or undesired heat or temperature to the beverage accessory device and the surrounding liquid or drink. An LED is preferred, however, those skilled in the art will recognize that any light source mechanism suited for the intended purposes may be employed and are not limited to these forms of light source mechanisms described above.

The power source 41 contemplates any means of providing energy to the light source 35 to thereby cause the light source 35 to emit light. A power source 41 suited for the intended purpose will suffice including, but not limited to, renewable batteries, rechargeable batteries, disposable batteries, power cells, watch batteries, and the like. If rechargeable, such power source 41 should be rechargeable by solar, magnetic, electrical, and chemical means, and the like or any combination thereof. One embodiment directs that the power source 41 be fully contained within the beverage accessory device and not to be in contact with its external environment. Those skilled in the art will recognize, however, that any power source mechanism suited for the intended purposes may be employed and are not limited to these forms of power source mechanisms.

The bias member 51 may be comprised of any suitable material or structure suited for the intended purpose such as, but not limited to a spring, a resilient pad, a single piece of VELCRO material, a foam pad, a corrugated plate, a spring plate, and the like or any combination thereof. In the preferred embodiment a foam-like member 51 is used. A typical foam-like member may be, but is not limited to, rubber, vinyl, polyethylene polyester, styrofoam, and the like, or any combination thereof.

Figure 4:
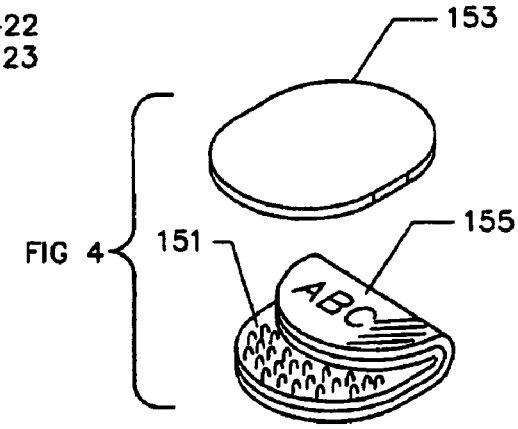
FIG. 4 is an exploded detail view of a support member for a power source according to one embodiment of the invention.
Figure 5:
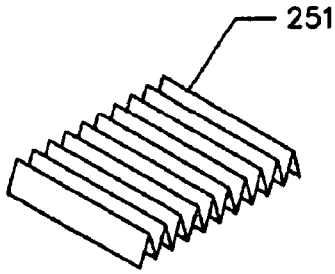
FIG. 5 is a detailed view of another embodiment of a support member for a power source.

A single piece of VELCRO material 151 (that is, the hook side of a hook-and-loop VELCRO, or the loop side of a hook-and-loop VELCRO) may also be used (see FIG. 4). In such case, a cover 153 would be placed on the VELCRO portion of this material. The VELCRO portions give this element the spring-like quality necessary to apply pressure or force to the power source 41 to thereby, in the process, provide support for the power source 41 within the power source chamber 21 and prevent unwanted movement. Printed indicia, as explained above, would be on the reverse side 155. FIG. 5 illustrates another type of bias member, that of a corrugated plate-like member 251. What is necessary for the support is application of upward force on the power source 41 to prevent it from moving when movement is not desired. Those skilled in the art will recognize, however, that any force applying mechanisms suited for the intended purposes may be employed and are not limited to these forms of bias member mechanisms.

Once the beverage accessory device is so constructed, a user would pick it up and strike an edge (for illustration purposes only, and not by way of limitation, we will adhere to relative positions of FIG. 1). To illuminate the beverage accessory device, the user would move the beverage accessory device in the direction of arrow A and strike the left side of the beverage accessory device on any suitable somewhat rigid surface. The force of this blow causes the power source 41 to slide from its right-most position, in the direction of arrow B to the left and cause the negative terminal of the power source 41 to contact the negative lead wire 33. Light thereupon is emitted. To turn off the light, the user strikes the right side of the beverage accessory device (direction of arrow B) causing the power source 41 to return to the right inside the power source chamber 21. Contact between the negative wire lead 33 and the negative terminal of the power source 41 is broken and the light thereupon extinguished. Those skilled in the art will recognize, however, that multiple switch mechanisms suited for the intended purposes, such as magnetic switches, mechanical switches, and electrical switches, and the like, may be employed and are not limited to this translating-type switch mechanism.

FIGS. 6 through 10 illustrate a conventional 'push-button' type power switch device 63. What has been described before with regard to the beverage accessory device which bears the same reference numerals for FIGS. 6–10 apply to this embodiment and are incorporated by reference. What distinguishes this embodiment from the previously discussed embodiment is the switch-facilitating mechanism comprising a mechanical switch device 63, on a foundation member 61, which is seated into a ledge 65 in the lid chamber 45. Any conventional switch device 63 will suffice. For this embodiment, however, a 'push-button' style is preferred. Here the positive lead wire 33 from the light source 35 is hard-wired into the foundation member 61 and connected to the switch device 63. Reference point 73 is the solder point for the positive lead wire 33 to the foundation member 61; reference point 74 is the solder point for the negative lead wire 34 to a clip-like member 84 which generally maintains constant contact with the power source 41. The power source 41 is held firmly in place thereat and, when switch device 63 is switched on or off, the light source 35 goes on or off as the case may be.

The clip-like member 84 is configured such that it seats firmly on the power source 41. It must be understood, however, that though the negative wire lead 34 is shown to be in constant contact with the power source 41 via the clip-like member 84, this configuration may be reversed and the positive wire lead 33 may be in constant contact with the power source 41 via the clip-like member 84 instead.

Figure 6:
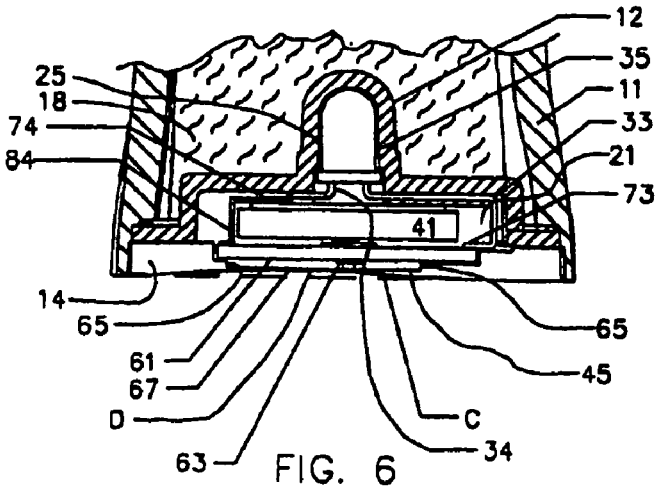
FIG. 6 is a detailed partial view of another embodiment of the beverage accessory of FIG. 1.
Figure 8:
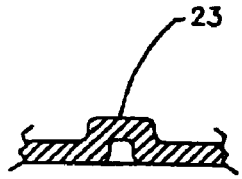
FIG. 8 is a detailed view of a lead chamber in the beverage accessory as taken along line 8—8 of FIG. 7.
Figure 7:
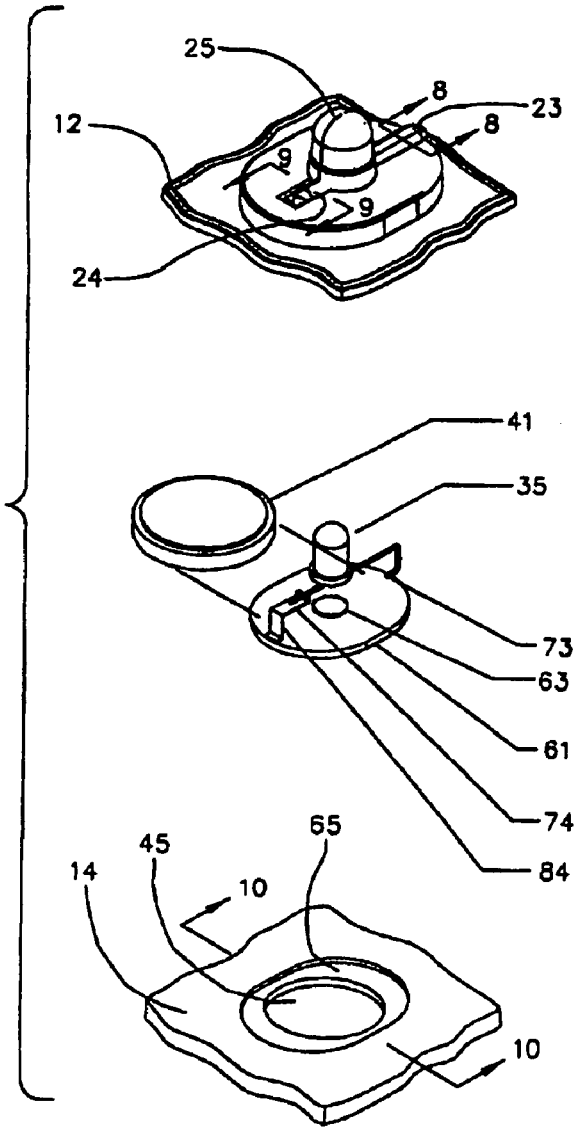
FIG. 7 is an exploded view of a beverage accessory according to another embodiment of the invention.
Figure 9:
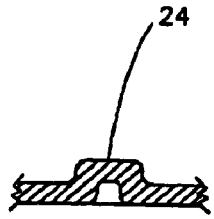
FIG. 9 is a detailed view of another lead chamber in the beverage accessory as taken along line 9—9 of FIG. 7.
Figure 10:
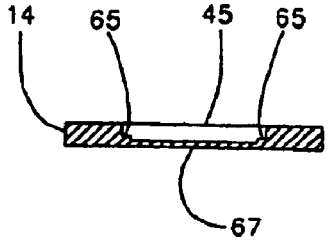
FIG. 10 is a detailed view of the lid as taken along line 10—10 of FIG. 7.

The lid 14 in this embodiment has a lid chamber 45 with a step or ledge 65. As was described, the foundation member 61, with switch device 63 in place, seats into the lid chamber 45 on the ledge 65. The switch device 63 is adjacent to the bottom of the lid chamber 45. The bottom of the lid chamber 45 here is relatively thin (or membrane-like 67) such that it flexes to the touch and exertion of some external pressure. The purpose of this resiliency and flexibility is to permit a user to contact the internal switch device 63 from the outside and to thereby switch the light source 35 'on' or 'off'. FIG. 6, reference character C (represented by phantom line) illustrates the position of the thin layer 67 in its normal position; reference character D illustrates its position after external pressure is exerted on the thin layer 67.

FIGS. 11 through 15 illustrate additional exemplary embodiments of a beverage accessory device. It should be noted, however, that any one or more of the previously described embodiments, components, elements, and features may also be employed with the exemplary embodiments shown in FIGS. 11 through 15.

Figure 11:
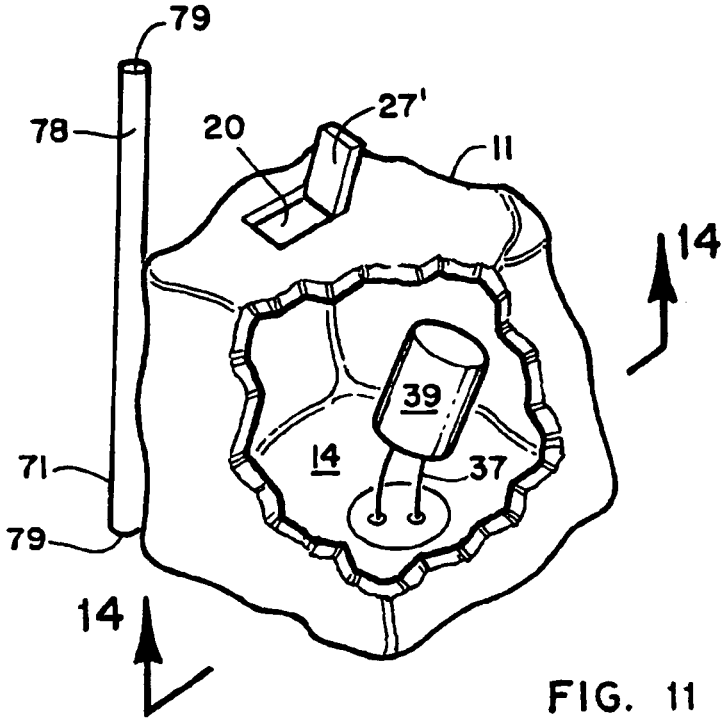
FIG. 11 is a cut-away perspective view of a beverage accessory according to another embodiment of the present invention.

As shown in FIGS. 11 through 15, the inside of the housing 11 is hollow, defining a cavity therein. A filler 18, generally, will be inside the cavity. In FIG. 11, the cavity within the housing 11 is exposed revealing the container 39. The container generally houses the light source 35, the power source 41, and may also, but need not, house the power switch member 163. These components 35, 41, 163 are shown to be encapsulated within the container 39 and, preferably (though not necessarily), in a water-tight fashion. For greater clarity, the filler 18 earlier described is not illustrated in FIGS. 11 through 15 although such can be used when buoyancy is desired, when heat-retaining and cold-retaining features are desired, or when a glow-in-the-dark feature is desired, or any one or more of the above in any desired combination. Buoyancy may also be attained by having an empty cavity. The filler 18, however, can be adapted to maintain the container 39 in suspension (i.e., in a suspended position) within the housing 11. In this regard, the container may be adjacent to any inside wall of the housing 11 (top, bottom, sides) and suspended anywhere within. The filler 18 generally should have buoyant characteristics, may have heat-retaining and cold-retaining characteristics, and may have glow-in-the-dark characteristics. Additionally, glass-like prisms, particles, colored or clear, may be inserted within the cavity, with or without a filler, such that the light from the light-source, when activated, is reflected and/or refracted to create yet an additional feature.

Figure 14:
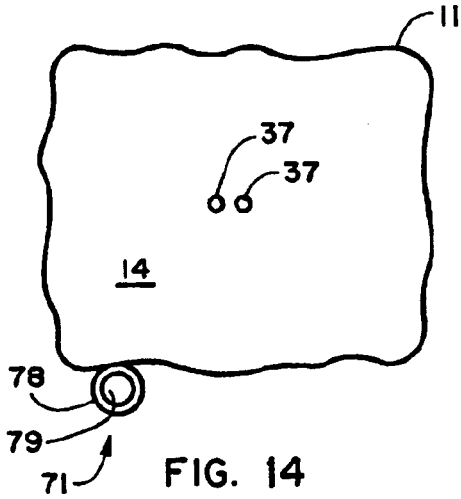
FIG. 14 is a bottom plan view of the device taken along line 14—14 of FIG. 11.
Figure 15:
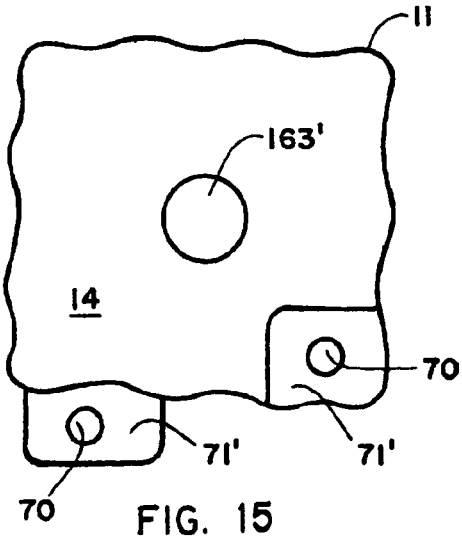
FIG. 15 is a bottom plan view of the device taken along line 15—15 of FIG. 12.

Conductive members 37 establish an on-off (switchable) connection between the power source 41, the light source 35, and a user. The switch member 163 may be manually activated by a user manually engaging a reciprocating switch, a push-button switch 163', or the like, each of which are accessible to a user from outside the housing 11. The switch member 163 also may be automatically activated by immersion of the device into a liquid which causes contact between the conductive members 37 to, depending on the mechanism used, interrupt a circuit and cause power to be delivered to the light source 35; or to complete the circuit and deliver power to the light source 35. FIG. 14 represents the structural feature and function of an automatically-operated switching function (i.e., by placing into a liquid, by covering with one's hand or finger, etc.). FIG. 15 represents the structural feature and function of one type of manually-operated switching function (i.e., a push-button type switch 163').

Any conventional chip or microprocessor is suited to function as the switch member 163 whether to be manually operated or automatically triggered. Typical such microprocessors are Model PEK 123508 manufactured or distributed by MicroChip; a Basic Discrete Logic Nand-Gate by MicroChip; or any 8-pin chips manufactured or distributed by Holtech. With the container 39 and its components all inside the housing 11, the light 35 may be illuminated automatically by immersing the device into a liquid; or if a manual push-button device is used, the light is illuminated by depressing the push-button device 163'. Many such switches may have a timer to regulate the duration of illumination, others may have a power-interrupting source such as a strobe to cause the illumination to flicker or strobe.

The power source 41 may be solar powered, may be rechargeable, may be permanently affixed to the device, or may be removable, or any compatible combination or combinations thereof. If a rechargeable power source is used, it may be permanently affixed and recharged by placing the entire device on a cooperating and compatible charging device. If a rechargeable power source is used, it may be removable and placed directly on a cooperating and compatible charging device. If removable, the device in such configuration also would encompass a lid 14 which also is removable.

Buoyancy-reduction may be realized in several ways. One manner provides for a removable lid 14 to expose the cavity and filler 18. Any type of weight (ballast) 47, in any number, may be inserted into the cavity to decrease buoyancy to any desired degree such that the device floats in a liquid on the surface, just below the surface, sinks to the bottom, or to any level between the surface and the bottom. The greater the density of the ballast 47, the more in number of the ballast 47, the less buoyancy for the device.

Figure 12:
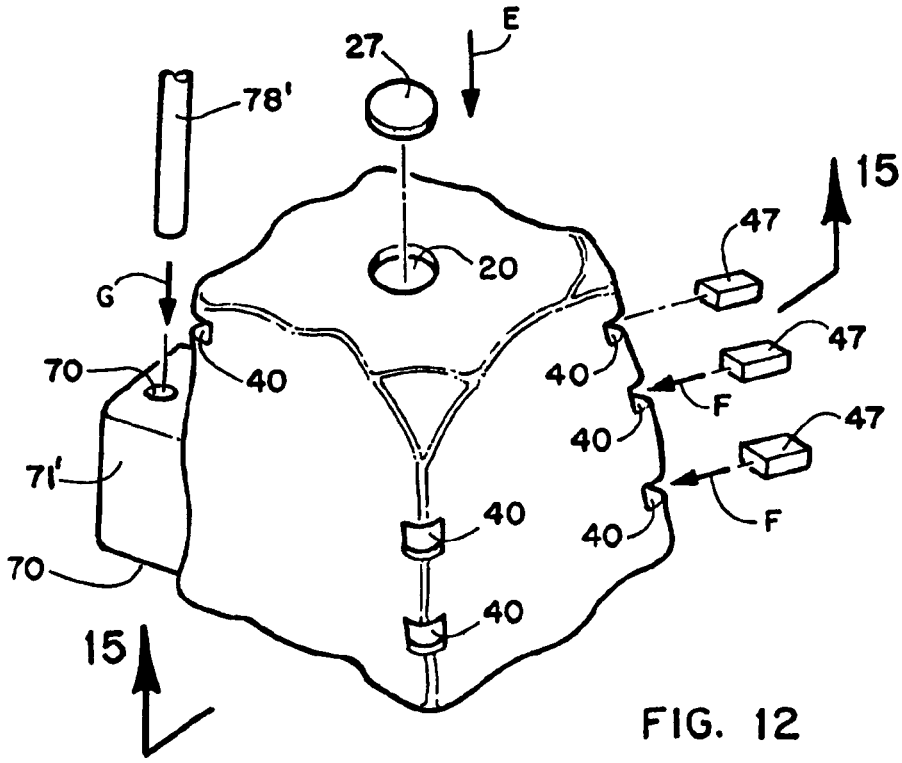
FIG. 12 is a perspective view of another embodiment of a beverage accessory.
Figure 13:
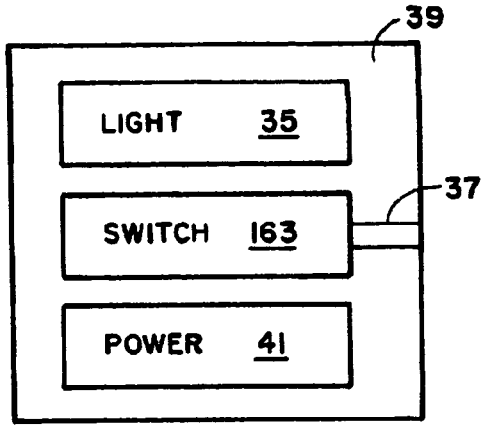
FIG. 13 is a schematic of the light, power, and switching components of the beverage accessory of FIG. 11.

Insertion of the ballast 47 may also be accomplished through an opening 20 on the housing 11 which, when in an open position, exposes the cavity and filler 18 within to the environment. When in the open position, any type and number of weights (ballast) 47 may be inserted into the cavity until the desired buoyancy level is attained. The opening 20 is secured into a closed position by a cap 27, 27' (FIGS. 12 and 11, respectively). The closed position is such that the device maintains a water-tight integrity (i.e., no water or liquid or virtually no water or liquid enters the cavity of the device when the device is immersed into the water or liquid).

As illustrated in FIG. 11, the cap 27' is a cap or door-like member hingedly connected to the opening 20. It opens and closes on the hinge and maintains a secure closure by friction-fit or by cooperating grooves and ribs or detents around the opening 20 and the cap 27'.

FIG. 12 illustrates a cap 27 which is not hingedly connected to the opening 20 but is completely removable from the opening 20. The cap 27 may be friction-fitting to the opening 20, may incorporate cooperating grooves and ribs or detents as above described, or may incorporate cooperating threading to be screwed on (into the closed position) and off (into the open position) as desired. The cap 27 is inserted over the opening 20 by movement in the direction of Arrow E until firmly seated on or into the opening 20.

Though the respective caps 27', 27 are shown as being rectilinear and curvilinear in shape, the caps 27', 27 may encompass any shape and may be placed anywhere on the device provided an open position and a closed position may be achieved and a water-tight integrity, if desired, is or may be attained and maintained. In either case, the device may be an empty cavity into which liquid, as a ballast, is introduced through the opening 20 and suitably sealed. The amount of buoyancy will depend upon the amount of liquid introduced into the cavity through the opening 20.

FIG. 12 also illustrates another buoyancy-reducing feature of the present invention which includes a plurality of slots or slits 40 adapted to receive the designated ballast 47. The slot 40 and respective ballast 47 are sized such that the ballast 47 firmly seats and remains in the slot 40. A user merely inserts any number of ballast members 47 or any type into one or more slots 40 (in the directions of Arrows F) until the desired level of buoyancy is attained.

An additional feature for the present invention is the straw receptacle 71 attached to the housing 11 or to the lid 14. As illustrated in FIG. 11, the straw receptacle 71 is an elongated tube 78 extending away from the device. The elongated tube 78 has an opening or channel 79 completely therethrough from top to the bottom. In FIG. 11, the straw receptacle 71 comprises a single straw-like member (elongated tube) 78. Alternatively, the straw receptacle 71 may also encompass a larger block-like structure 71' as illustrated in FIGS. 12 and 15. With the block-like structure 71', an elongated tube 78 may extend away from the block-like structure 71' provided the channel 79 of the elongated tube 78 extends completely through the block-like structure 71'. This provides for a stronger and more durable straw feature for the device to facilitate or assist a user in consuming the beverage into which the device has been placed.

Referring to FIG. 12, the straw receptacle 71' as a block-like structure may also be structured without a permanent elongated tube 78 thereon but may have an aperture 70 running completely through the straw receptacle 71', which aperture 70 is adapted to receive and hold an externally introduced straw 78' (in the direction of Arrows G as illustrated in FIG. 12).

Figure 16:
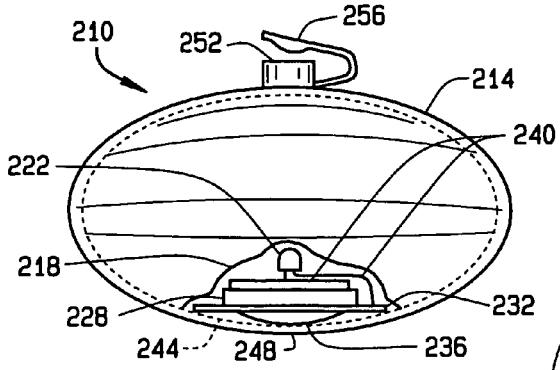
FIG. 16 is a view of another embodiment of a beverage accessory.

FIG. 16 illustrates another embodiment of a beverage accessory device 210. As shown, the beverage accessory device 210 includes an outer housing 214 in which is positioned a filler and an inner container or pod 218.

The inner container 218 includes at least one light source 222, at least one power source 228, and a controller for controlling the operation of the light source 222 in accordance with user input, for example, to provide such features as blinking, strobing, and/or color changes. The controller can include an integrated circuit/printed circuit assembly 232 (e.g., integrated circuits in a printed circuit assembly) and at least one switch 236.

The controller can include any one of a wide range of switches, a push-button switch, a dome push switch, a membrane switch, motion-responsive switches, light-sensitive switches, temperature-sensitive switches, compression switches, voice activated switches, etc. In the particular embodiment shown in FIG. 16, the controller includes a push-button switch 236. In the alternative embodiment shown in FIG. 18, the beverage accessory 410 includes electrical terminals or probes 436 external to the outer container 414. When the beverage accessory device 410 is placed in an electrically conductive liquid, the liquid electrically connects the terminals 436 to one another thereby switchably connecting the light source 422 to the power source 428. Or for example, the terminals 436 can switchably connect the light source 422 to the power source 428 when both terminals 436 are placed in contact with a user's body.

With further reference to FIG. 16, the light source 222, power source 228, integrated circuit/printed circuit assembly 232, switch 236, and leads or conductors 240 can all be encapsulated by the inner container 218 in a preferably fluid-tight fashion. This, in turn, can help prevent the filler within the housing 214 from contacting (and potentially causing problems with the operation of) the various components encapsulated within the inner container 218. In addition, the inner container 218 can also at least help support and retain the positioning of the light source 222, power source 228, and conductors 240 electrically connecting the various components to one another.

In FIG. 16, the inner container 218 is shown coupled (e.g., bonded, adhered, affixed, hot-melted, etc.) to an inner surface 244 of the outer container 214. By way of example only, the inner container 218 can be formed and coupled to the inner surface 244 as follows. First, a vinyl or other suitable material can be sufficiently heated to melt or at least substantially liquefy the vinyl material. The substantially liquefied vinyl material can then be disposed (e.g., poured) over the light source 222, power source 228, integrated circuit/printed circuit assembly 232, switch 236, and leads 240. A sufficient amount of the liquefied vinyl material can be used so that it not only encapsulates the light source 222, power source 228, integrated circuit/printed circuit assembly 232, switch 236, leads 240, but also comes into contact with the inner surface 244. The vinyl material can then be cooled (e.g., passively allowed to cool and/or actively cooled) so that the vinyl material solidifies, thereby forming the inner container 218. Alternatively, other methods can be used to form the inner container and/or the inner container may instead be suspended or floating within the filler as described below and shown in FIG. 17.

The outer container 214 preferably includes at least one externally flexible portion 248 coupled to the switching device 236 such that movement of the flexible portion 248 activates the switching device 236 to connect the light source 222 to the power source 228. The movement of the flexible portion may, for example, be caused by a user applying external pressure to the outer container 214 by squeezing the outer container 214 at the externally flexible surface portion 248.

The outer container 214 can also define at least one opening 252 through which filler can be added to or removed from the outer container 214. The beverage accessory device 210 can include a cap or lid 256 for exposing the opening 252 when the cap 256 is in an open position (as shown in FIG. 16) and for closing the opening 252 when the cap 256 is coupled to the housing 214 in a closed position. In this exemplary manner, filler (e.g., fluids, liquids, gels, oils, ballast, etc.) can be added to or removed from the housing 214, for example, to change the buoyancy of the device 210. In alternative embodiments, however, the outer container does not include an opening for adding or removing filler, such as the device 410 shown in FIG. 18.

In the illustrated embodiment of FIG. 17, the beverage accessory device 310 includes an inner pod 318 suspended by or floating within the filler contained with the housing 314 such that the inner pod 318 is a spaced distance from the housing's sidewalls. At least one light source 322, power source 328, integrated circuit/printed circuit assembly 332, switch 336, and leads 340 can all be encapsulated by the inner container 318 in a preferably fluid-tight fashion.

In the particular embodiment shown in FIG. 17, the switch 336 is a dome or push-button switch, although other types of switching devices can also be employed. In addition, the entirety of the outer container 314 is preferably sufficiently flexible (e.g., formed of a relatively soft plastic or vinyl material, etc.) such that applying pressure to (e.g., by a user squeezing or compressing, etc.) any portion of the outer container 314 compresses the filler material within the outer container 314. In turn, the filler material transmits a compression force to the inner container 318 causing the switch 336 to activate and connect the light source 322 to the power source 328. A wide range of filler materials having properties or characteristics suitable for transmitting the compression force to the inner container can be used in the embodiment illustrated in FIG. 17.

Figure 17A:
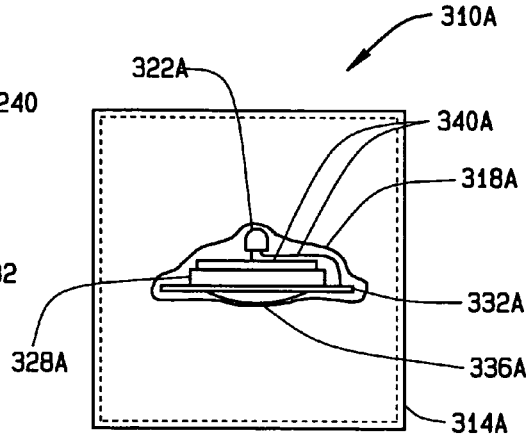
FIG. 17A is a view of another embodiment of a beverage accessory.
Figure 17B:
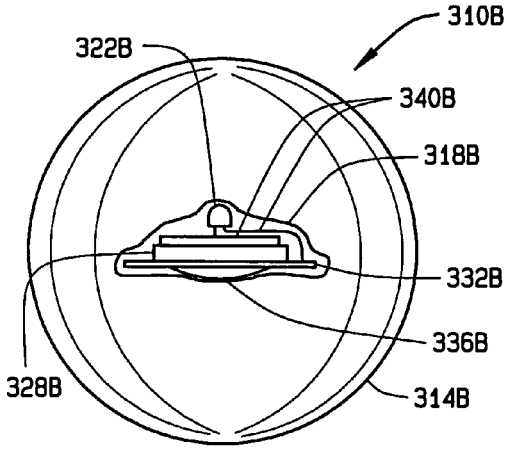
FIG. 17B is a view of another embodiment of a beverage accessory.

In FIG. 17A, the housing 314A is substantially cube-shaped. The housing 314A can also be decorated to resemble an ice cube or ice berg. In FIG. 17B, the housing 314B is substantially spherical. The housing 314B can also be decorated to resemble a sports ball (e.g., golf ball, basketball, soccer ball, baseball, football, tennis ball, etc.). Alternatively, a wide range of other shapes can be used for the housing 314 including food substances (e.g., a food substance (e.g., a slice of fruit, an olive, an onion, etc.) tear drops, rain drops, alphanumeric characters, pyramids, dice, among others.

Figure 19:
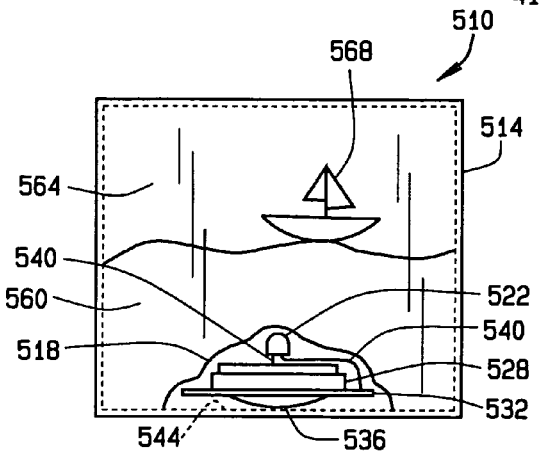
FIG. 19 is a view of another embodiment of a beverage accessory.

With reference now to FIG. 19, there is shown a beverage accessory device 510 that includes a housing 514 in which is disposed at least two fillers 560 and 564 each having different densities. As shown in FIG. 19, the fillers 560 and 564 have separated with the more dense filler 560 having gravitated to the lower portion of the housing 514.

The beverage accessory device 510 can also include a sailboat 568 (or other suitable object) configured to remain or be suspended at about the interface between the fillers 560 and 564. For example, the boat 568 can be sufficiently buoyant to float on the denser filler 560, but have sufficient negative buoyancy to sink in the less dense filler 564. The boat 568 can also be weighted so that it remains generally upright while suspended generally between the two fillers 560 and 564. In other embodiments, the beverage accessory device can include other suitable objects and indicia besides or in addition to boats, such as fish, dolphins, birds, plants, etc.

To even further enhance the visual appeal of the beverage accessory device 510, the denser filler 560 can be blue in color while the other less dense filler 564 is generally clear or transparent. In this exemplary manner, the sailboat 568 can thus appear to be floating on the open sea.

A wide range of materials can be used for the fillers 560 and 564. In one embodiment, the denser filler 560 is liquid water that has been colored or dyed blue, while the other filler 564 is a generally clear oil.

In addition to (or as alternative) to using a blue filler 560, the beverage accessory device 510 can produce blue light to even further reinforce the appearance that the boat is floating on the open sea. By way of example, the beverage accessory device 510 can include one or more LEDs 522 that produce blue light and/or that produce broadband light that travels through a colored filter.

Figure 18:
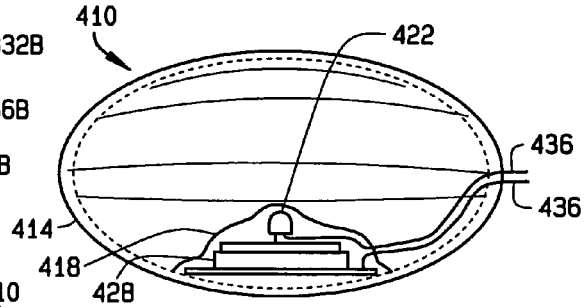
FIG. 18 is a view of another embodiment of a beverage accessory.

As before with FIGS. 16 through 18, the beverage accessory device 510 can also include an inner pod 518 encapsulating in a preferably fluid-tight fashion the LEDs 522, power source 528, conductors 540, and a controller. In FIG. 19, the inner container 518 is shown coupled (e.g., bonded, adhered, affixed, hot-melted, etc.) to an inner surface 544 of the outer container 514. Alternatively, the inner container may instead be configured to be suspended within one of the fillers 560 and 564.

The controller can include an integrated circuit/printed circuit assembly 532 (e.g., integrated circuits in a printed circuit assembly) and at least one switch 536. The switch can include any one of a wide range of switches, a push-button switch, a dome push switch, a membrane switch, motion-responsive switches, light-sensitive switches, temperature-sensitive switches, compression switches, voice activated switches, moisture-sensitive switches, etc.

A wide range of materials can be used for the outer and inner containers 214, 218, 314, 318, 414, 418, 514, 518 shown in FIGS. 16 through 19. In preferred implementations, the inner and outer containers are formed from a biologically safe material that has properties suitable for placing it in contact with a material that is to be ingested and falls under the Food and Drug Administration food-contact grade properties. Exemplary materials include polyvinyl chloride (PVC), polymers, plastics, flexible materials, rigid materials, materials capable of being mass produced with relatively low manufacturing costs, among other materials suited for the intended purpose.

In embodiments which the filler material is freezable, an internal cavity without any the freezable filler can be defined between the switching device and a flexible sidewall portion of the outer container. This internal cavity can enable a compression force initially applied to the outer container to be transmitted to the inner container for activating the switching device therein even when the filler material is frozen solid. Alternatively, the inner container can be flush against and in contact with a flexible sidewall portion of the housing such that movement to the flexible sidewall portion activates the switching device regardless of whether the filler is frozen or not.

Figure 20:
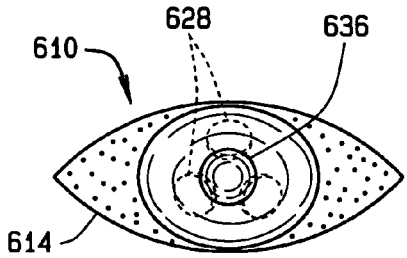
FIG. 20 is a view of another embodiment of a beverage accessory.
Figure 21:
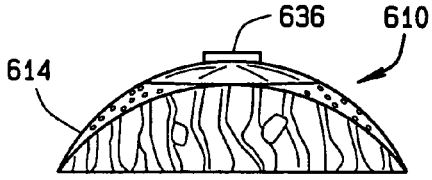
FIG. 21 is another view of the beverage accessory shown in FIG. 20.

FIGS. 20 and 21 illustrate a beverage accessory device 610 that includes a housing 614 adapted to resemble a slice or piece of an orange fruit. In alternative embodiments, the housing can be adapted to resemble other pieces or entire fruits, such as slices of a lime or lemon.

As shown in FIGS. 20 and 21, the beverage accessory device 610 includes a push-button switch 636, but other types of switches can also be employed. In operation, the push-button switch 636 switchably connects one or more light sources to one or more power sources 628 (shown in phantom). In the particular illustrated embodiment, the power sources include three watch batteries, although other suitable types and numbers of power sources can be used depending on the particular application.

In various embodiments, the beverage accessory device can produce light having a color consistent with the color of the fruit or object that the beverage accessory is intended to resemble. For example, the beverage accessory device 610 shown in FIG. 17 may be configured to produce orange light so as to even further reinforce the beverage accessory's appearance as an orange slice. The beverage accessory device 610 can include one or more LEDs that produce orange light and/or broadband light that travels through a colored filter. Other embodiments include a beverage accessory adapted to resemble a lemon slice and that produces yellow light, and a beverage accessory adapted to resemble a lime slice and that produces green light. Accordingly, various embodiments of the invention include a beverage accessory device that produces thematic light (e.g., certain colors, etc.) consistent with the particular object or theme for which the device configured to resemble.

Figure 22:
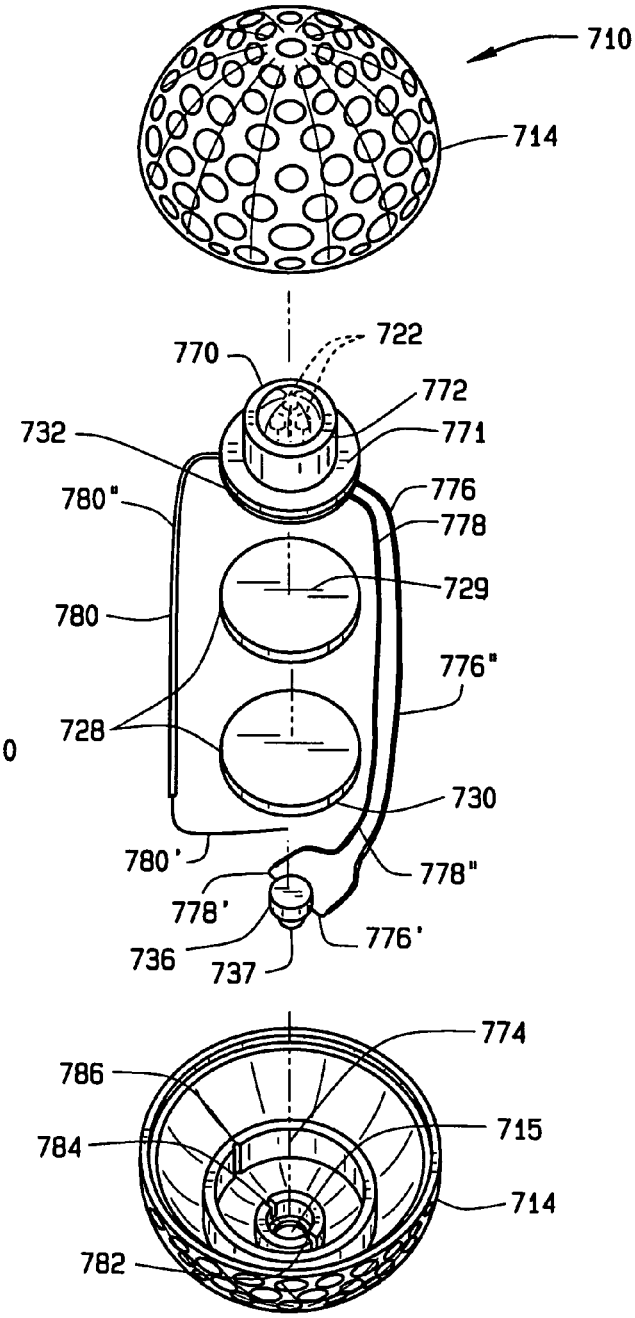
FIG. 22 is an exploded perspective view of another embodiment of a beverage accessory.

FIG. 22 illustrates another embodiment of a beverage accessory device 710 adapted to resemble a golf ball. As shown, the device 710 includes a generally spherical housing 714 with a dimpled external surface.

The beverage accessory device 710 further includes a cartridge 770 sized to be received within the housing 714. The cartridge 770 defines a light source chamber 772 thereunder sized to receive one or more light sources, such as the LEDs 722 (shown in phantom). The housing 714 and cartridge 770 cooperate to define a power source chamber 774 sized to receive one or more power sources. In the particular illustrated embodiment, the power source chamber 774 is sized to receive two three-volt lithium batteries 728 electrically connected in series.

The beverage accessory device 710 can also include a controller for controlling the operation of the LEDs 722 in accordance with user input, for example, to provide such features as blinking, strobing, and/or color changes. The controller can include an integrated circuit/printed circuit assembly 732 (e.g., integrated circuits in a printed circuit assembly) and at least one switch 736.

As shown in FIG. 22, the switch 736 is a push-button switch having a portion 737 sized to extend through an opening 715 defined by the housing 714. A user can thus activate the switch 736 by pressing on the portion 737 of the switch 736 extending out through the opening 715 in the housing 714. Alternatively, a wide range of other switching devices can be employed for the device 710.

With further reference to FIG. 22, the integrated circuit/printed circuit assembly 732 can be disposed generally between the light source chamber 772 and the power source chamber 774. The integrated circuit/printed circuit assembly 732 can include an electrically conductive lower surface configured to electrically contact the upper terminal 729 (whether a negative terminal or cathode or a positive terminal or anode) of the upper battery 728 when the beverage accessory device 710 is fully assembled.

The beverage accessory device 710 can also include a plurality of conductors or leads 776, 778, 780. As shown, the leads 776, 778 are electrically connected to the switch 736. The lead 780 is configured to contact the lower terminal 730 (whether a negative terminal or cathode or a positive terminal or anode) of the lower battery 728 when the beverage accessory device 710 is fully assembled.

The housing 714 can also define grooves or channels 782, 784, 786 each for engaging a different one of the wire leads 776, 778, 780. Engaging the wire leads 776, 778, 780 within the corresponding grooves 782, 784, 786 can help maintain the positioning of the wire leads and reduce the chance that the wire leads will be electrically disconnected from the light source 722, power source 728, integrated circuit/printed circuit assembly 732, and/or switch 736 as the case may be.

Each wire lead 776, 778, 780 can include electrically insulative portions 776', 778', 780' and electrically conductive portions 776", 778", 780". The electrically insulative portions 776', 778', 780' can help prevent short circuiting that might otherwise occur if the electrically conductive portions 776", 778", 780" physically contacted each other and/or the battery sidewalls.

In some embodiments, the cartridge 770 can also define channels (not shown) similar to the lead channels 23, 24 defined by the cartridge 12 described above. For example, in one embodiment, the flange portion 771 of the cartridge 770 can define channels (e.g., grooves, holes, etc.) for the leads 776, 778, 780. In other embodiments, however, the cartridge 770 does not define any of such lead channels.

In any of the various embodiments illustrated in FIGS. 16 through 22, the device can also include means for allowing the buoyancy of the beverage accessory device to be adjusted, for example, to float on top of a beverage, to submerge to a suitable depth within the beverage, or to sink completely to the bottom of the beverage. This buoyancy adjustment can be realized in several ways. In various implementations, buoyancy-reduction is accomplished by simply positioning one or more batteries within a power source chamber. In which case, the buoyancy of the device will be determined, at least in part, on the type and number of power sources positioned within the power source chamber. Another exemplary manner for adjusting buoyancy can include the device having a lid or cap for exposing an internal cavity to allow a fluid (e.g., liquid, air, etc.) to be inserted into the cavity to adjust the buoyancy of the device.

In various embodiments of the invention, the device's exterior can be provided in various shapes, sizes, and/or be adapted to resemble a wide range of objects, such as a simulated ice cube (FIGS. 1, 11, 12, and 17A), an ice berg, a test-tube-like or capsule-like structure, a sphere (FIG. 17B), a cube with a boat floating on the open sea (FIG. 19), a food substance (e.g., a slice of fruit (FIGS. 20 and 21), an olive, an onion, etc.), dice, a golf ball (FIG. 22), other sports ball shapes, and the like. Any of these various embodiments can be illuminatable and/or immersible in a liquid (to float or partially or completely sink within a liquid).

In any of the various embodiments of the invention, the beverage accessory can include a plurality of light-altering particles (e.g., glitter, reflective particles, refractive particles, translucent particles, glass-like prisms, colored particles, clear particles, etc.) within the housing (e.g., suspended within the hot/cold gel or other suitable substance within the housing). These particles can receive and alter the light from a light source to create yet an additional feature. For example, the altered light can produce a visibly pleasing or sparkling light effect. Indeed, various embodiments can produce such visibly pleasing light effects that a user may simply choose to use the device even while not consuming a beverage.

In any of the various embodiments of the invention, the operation of the light sources may be controlled by a controller in accordance with user input to provide such features as blinking, strobing and/or color changes. The controller can include an integrated circuit/printed circuit assembly (e.g., integrated circuits in a printed circuit assembly) and at least one switch. The switch may, for example, allow the user to select from among various display modes for the light sources, such as an off-light mode, an on-light mode, a mode in which each of the light sources simultaneously emit steady or non-flashing light, a mode in which the light sources emit light intermittently, a mode in which the various light sources illuminate or blink at different times in accordance with a predetermined sequence or order, a mode in which the light sources emit light that phases between or blends colors, a mode in which the light sources emit light randomly, a mode in which the light sources pulsate to sounds, and/or a mode combining one or more of the foregoing. Such sounds may be produced by the lighted item itself (e.g., via a speaker built-in to the lighted item) or a source external to the lighted item (e.g., ambient sounds). In some embodiments, sounds can cause synchronized pulsation of the light sources of two or more different lighted items, thus providing a pleasing light pattern or effect.

In any of the various embodiments of the invention, the housing, or at least a portion thereof, can be ultraviolet-reactive, and the light source(s) can produce ultraviolet light for illuminating the ultraviolet-reactive housing. For example, the housing, or at least a portion thereof, can be responsive to the ultraviolet A (UVA) radiation component of black light produced by the light source, which, in turn, produces a visually stimulating effect. Additionally, or alternatively, a beverage accessory can also include a ultraviolet-reactive material within the housing. In which case, the ultraviolet-reactive material can be responsive to the ultraviolet A (UVA) radiation component of black light produced by the light source, which, in turn, produces a visually stimulating effect. Exemplary ultraviolet-reactive materials that can be used for a housing and/or a filler within the housing include plastic materials containing phosphor (e.g., Zinc Sulfide, Strontium Aluminate) and fluorescent materials.

Accordingly, various embodiments of the invention provide a relatively easy and inexpensive way to enhance a mood or atmosphere of an occasion, to provide visual pleasure or serenity (e.g., enhance one's enjoyment while consuming a beverage), to convey messages to users (e.g., by providing the device with one or more indicia), among other numerous novelty-related results. Various embodiments can be adapted to accept and maintain an external drinking implement (such as a straw) to facilitate drinking or sipping a beverage.

Various embodiments can also include appropriate fillers capable of imparting heating, cooling, and/or glow-like illumination properties to the adjacent environment.

The description of the invention is merely exemplary in nature and is in no way intended to limit the invention, its application, or uses. Thus, variations that do not depart from the substance of the invention are intended to be within the scope of the invention. Such variations are not to be regarded as a departure from the spirit and scope of the invention.

What is claimed is:

1. A beverage accessory device comprising a housing defining a cavity therein, a substantially fluid-tight container within the housing and configured to receive at least one power source therein, at least one light source substantially entirely within the container, the light source when connected to the power source illuminating at least a portion of a liquid when the beverage accessory device is placed in the liquid, and a filler within the cavity, the filler maintaining the container in a suspended position within the housing a spaced distance from each sidewall of the housing, the housing including at least one flexible portion such that movement of the flexible portion causes the filler to activate a switching device within the container and, thereby, to switchably connect the light source to the power source.

2. The device of claim 1, wherein the container encapsulates the light source and at least one conductor electrically connected to the light source such that the container supports and restrains movement of the light source relative to the conductor.

3. The device of claim 1, wherein the housing includes at least one sidewall, and wherein each said sidewall is flexible such that movement of any of said sidewalls causes the filler to activate a switching device within the container and, thereby, to switchably connect the light source to the power source.

4. The device of claim 1, wherein the filler comprises a fluid.

5. The device of claim 4, wherein the filler comprises air.

6. The device of claim 1, wherein the at least one flexible portion has an inner surface to which the container is coupled such that movement of the flexible portion activates a switching device within the container and, thereby, to switchably connect the light source to the power source.

7. The device of claim 1, further comprising electrical terminals external to the housing for switchably connecting the light source to a power source when the beverage accessory device is placed in a liquid and the liquid electrically connects said terminals to one another.

8. The device of claim 7, wherein the electrical terminals are defined by at least one conductor extending from within the container through the cavity and external to the housing.

9. The device of claim 1, wherein the device is configured to produce thematic light.

10. The device of claim 9, wherein the housing is configured as a slice of fruit, and the device produces light having a color corresponding to a natural color of the fruit.

11. The device of claim 1, further comprising at least two fillers within the cavity, each said filler having a different density so as to substantially separate within the cavity, and an object configured to be suspended at about an interface separating the fillers.

12. The device of claim 1, wherein at least one of the housing, the container, and a filler within the cavity includes at least a portion reactive to ultraviolet light, and wherein the light source comprises at least one ultraviolet light source for directing ultraviolet light at the ultraviolet-reactive portion.

13. The device of claim 1, further comprising gel within the cavity external to the container.

14. The device of claim 1, wherein the housing integrally defines at least a portion of the container.

15. A beverage accessory device comprising a housing defining a cavity therein, a cartridge within the housing, the cartridge defining thereunder a light source chamber and a power source chamber such that the light source chamber and power source chamber are substantially sealed from the cavity, the power source chamber configured to receive at least one power source therein, at least one light source within the light source chamber, the light source when connected to the power source illuminating at least a portion of a liquid when the beverage accessory device is placed in the liquid, and a lid engaged with the housing such that fluid-tight integrity is maintained within the housing, the lid including a lid chamber mating with the power source chamber to contain the power source therein.

16. The device of claim 15, wherein the cartridge and the housing cooperate to define the power source chamber.

17. The device of claim 16, wherein the housing defines at least one groove within the power source chamber, the groove engaging at least one conductor electrically connected to the light source.

18. The device of claim 16, wherein the housing defines first, second and third grooves within the power source chamber, each said groove engaging a different conductor electrically connected to the light source.

19. The device of claim 15, further comprising at least one channel defined by the cartridge and in communication with the light source chamber, the channel engaging a conductor electrically connected to the light source.

20. The device of claim 15, wherein the cartridge defines thereunder at least two channels in communication with the light source chamber, each said channel engaging a different conductor electrically connected to the light source.

21. The device of claim 15, wherein the power-source chamber is sized to permit the power source to reciprocally translate therein for switchably connecting the light source to the power source.

22. The device of claim 15, further comprising electrical terminals external to the housing for switchably connecting the light source to a power source when the beverage accessory device is placed in a liquid and the liquid electrically connects said terminals to one another.

23. The device of claim 15, further comprising a push-button switching device for switchably connecting the light source to a power source.

24. The device of claim 15, further comprising a filler within the cavity.

25. The device of claim 24, wherein the filler comprises a fluid.

26. The device of claim 25, wherein the filler comprises air.

27. The device of claim 15, further comprising gel within the cavity, and wherein the cartridge substantially seals the light-source chamber and the power-source chamber from the gel within the cavity.

28. The device of claim 15, further comprising light-altering particles within the cavity including at least one or more of glitter, reflective particles, refractive particles, translucent particles, glass-like prisms, colored particles, faceted particles, and clear particles.

29. The device of claim 15, further comprising a filler within the cavity in which light-altering particles are suspended.

30. The device of claim 15, further comprising a beaded material within the cavity.

31. The device of claim 15, further comprising light-altering particles within the cavity, and wherein the light-altering particles comprise gel.

32. The device of claim 15, wherein the outer features of the illuminatable beverage accessory device simulate the contours of a real ice cube.

33. The device of claim 15, wherein the housing comprises a substantially transparent material, whereby the housing is not readily visible when the beverage accessory device is within a liquid and the light source is emitting light and illuminating at least a portion of the liquid.

34. A beverage accessory device comprising a housing defining a cavity therein, the housing including at least one sidewall, at least one light source, a substantially fluid-tight container within the housing and configured to receive at least one power source therein, the container encapsulating the light source and at least one conductor electrically connected to the light source such that the container supports and restrains movement of the light source relative to the conductor, and a filler within the cavity, the filler maintaining the container in a suspended position within the housing a spaced distance from each said sidewall, each said sidewall being flexible such that movement of any of said sidewalls causes the filler to activate a switching device within the container and, thereby, to switchably connect the light source to the power source, the light source when connected to the power source illuminating at least a portion of a liquid when the beverage accessory device is placed in the liquid.

35. The device of claim 34, wherein the filler comprises gel.

36. A beverage accessory device for use within a beverage receptacle, the beverage accessory device comprising a housing, at least one electric light source within the housing, gel within the housing, and a lid engaged with the housing such that fluid-tight integrity is substantially maintained within the housing, the lid including a lid chamber mating with a power source chamber to contain at least one power source therein, and at least one groove engagingly receiving at least one conductor electrically connected to at least one of the electric light source and the power source, whereby the electric light source is operable for illuminating at least a portion of a liquid within the beverage receptacle when the beverage accessory device is within the beverage receptacle.

37. The device of claim 36, wherein the outer features of the illuminatable beverage accessory device simulate the contours of a real ice cube.

38. The device of claim 36, wherein the electric light source is operable for brightly illuminating at least a portion of an iced liquid within the beverage receptacle when the beverage accessory device is within the beverage receptacle.

39. The device of claim 36, further comprising a plurality of light-altering particles within the housing for receiving and altering light emitted by the electric light source by at least one or more of refracting, reflecting, diffracting, dispersing, and diffusing such that the altered light illuminates at least a portion of a liquid within the beverage receptacle when the beverage accessory device is within the beverage receptacle.

* * * * *